United States Patent [19]

Greene et al.

[11] Patent Number: 4,890,136

[45] Date of Patent: Dec. 26, 1989

[54] VENTILATING SYSTEM FOR DIAZO PROCESS PRINTING MACHINES

[75] Inventors: Michael Greene, Baltimore, Md.; Norman Michlin, Dearborn, Mich.

[73] Assignee: Michlin Diazo Products, Dearborn, Mich.

[21] Appl. No.: 194,205

[22] Filed: May 16, 1988

[51] Int. Cl.[4] ..... G03D 7/00; G03G 27/30

[52] U.S. Cl. ..... 355/27; 354/300; 55/387

[58] Field of Search ..... 55/227, 316, 387; 355/14 R, 27, 106, 100, 30; 354/299, 300

[56] References Cited

U.S. PATENT DOCUMENTS

| | | | |
|---|---|---|---|
| 3,147,687 | 9/1964 | Halden | 354/300 X |
| 3,727,534 | 4/1973 | Low et al. | 354/300 |
| 4,153,435 | 5/1979 | Fischer | 55/227 |
| 4,167,319 | 9/1979 | Feitzinger et al. | 354/300 |
| 4,303,329 | 12/1981 | Michlin | 354/300 |
| 4,512,654 | 4/1985 | Feitzinger et al. | 355/27 |
| 4,786,947 | 11/1988 | Kosugi et al. | 355/30 |

*Primary Examiner*—Donald A. Griffin
*Attorney, Agent, or Firm*—Krass & Young

[57] ABSTRACT

A ventilation system for a diazo copy machine of the type having an exposure chamber containing a source of illumination for exposure of an original image onto diazo copy material and developer chamber utilizing ammonia vapors to develop the image on the diazo copying material. The ventilation apparatus comprises separate means for ventilating the exposure chamber and for ventilating the developing chamber. Inlet means are provided in the exposure chamber for admitting ambient air thereinto, and outlet means are provided for venting hot air from the exposure chamber into the ambient environment. Vacuum means are provided for exhausting ammonia-laden air from the developing chamber, and an absorber chamber is provided which is in fluid communication therewith, cartridge means being disposed within the absorber chamber for selectively absorbing ammonia fumes. Ammonia-laden fumes are drawn from the developing chamber into the absorber cartridge and then exhausted into the ambient environment.

11 Claims, 2 Drawing Sheets

VENTILATING SYSTEM FOR DIAZO PROCESS PRINTING MACHINES

BACKGROUND OF THE INVENTION

This invention relates to ventilating systems for diazo process printing machines and, more particularly, to such a system with separate airflows through the exposure chamber and the developing chamber of such a machine.

DESCRIPTION OF THE RELEVANT PRIOR ART

Diazo copy machines utilize ammonia vapor which is brought into contact with a diazo die-coated copy material previously exposed with respect to an original overlaying the same. The ammonia reacts with the diazo dies to produce a developed print. The process is very useful and is in extremely widespread use for the reproduction of, for example, blueprints, but it does have the disadvantage of incidental generation of ammonia fumes associated with the operation of the machine and with the developed prints. The ammonia vapor not only has an unpleasant order, but it may actually be harmful to human health in heavy concentrations.

In an effort to eliminate or minimize such odors, diazo copy machines have heretofore been provided with suction chambers which collect and supply a vacuum to a region adjacent the development chamber which serves to collect the ammonia vapors escaping therefrom, as well as those given off by the developed copy material. The ammonia vapor containing exhaust from the suction chamber cannot be directly exhausted to the room air. In large volume, heavy duty, diazo printing machines this exhaust is vented to the exterior of the building housing the machines to minimize the exposure of operating personnel to the noxious ammonia vapor. With smaller machines, this exterior venting is often impractical or uneconomical. For the smaller machines, alternative methods have been used in which the ammonia laden exhaust from the machines is passed over chemical ammonia absorbents and then vented directly in the room housing the machines. Examples of patents disclosing venting systems of this type and absorbent cartridges for use therein include U.S. Pat. Nos: 4,303,329; 4,333,752; 4,334,756; 4,397,663; and 4,473,282, all of which patents are assigned to the assignee of the instant invention.

Both types of ventilating systems described above present certain disadvantages. In order to vent the ammonia laden exhaust to the exterior of the building, elaborate ducting systems must be provided. Installation of such a system can be a great expense, and the potentially harmful fumes are still being vented out into the environment where they can potentially do some harm. While passing the ammonia laden vapors over chemical absorbents does the least amount of environmental damage, it has been found that the high volumes of air which are passed through the system tend to reduce the life of the absorbents, thereby increasing the cost and reducing the practicality of the system.

Typically, a diazo copy machine includes separate exposure and developing chambers. In the exposure chamber, the original and the diazo die coated copy material are exposed to a source of illumination, typically a fluorescent tube. The tube is mounted in a conventional lamp housing. After the die coated copy material has been exposed, it is removed from the exposure chamber and caused to enter the development chamber, whereon it is exposed to the ammonia fumes for development. In the ventilating systems described in the above-referenced U.S. Patents, the ammonia fumes are evacuated by using a blower contained within the copy machine to pull a vacuum on the machine frame. The air used for ventilating and cooling the exposure chamber is ammonia laden air from the machine which passes into the exposure chamber through the conventional lamp end housing. While it is necessary to pass a stream of air through the exposure chamber to provide ventilation and cooling, it is only an accidental feature of the prior art ventilating systems that causes the ammonia laden air from the developing chamber to be circulated in this manner for ventilating the exposure chamber. Thus, by having one unitary air flow system for both the exposure and the developing chambers, a large volume of air must be necessarily run through the system, which large volume of air is also passed through the absorber. Hence, the life of the absorber is unnecessarily short.

It is herein proposed to separate the air flows passing through the exposure chamber and through the developing chamber, thereby eliminating the disadvantages noted above. By providing a separate air flow for the exposure chamber, a relatively large volume of air can be run therethrough and, since this air flow does not contain ammonia vapors, it can be vented into the immediate environment. By providing a self-contained ventilation system for the developing chamber, a much smaller volume of air can be run through the absorber, thus extending the life thereof and preventing channelization of the absorbing material.

SUMMARY OF THE INVENTION

Disclosed and claimed herein is a ventilation system for use with a diazo copy machine of the type having an exposure chamber provided with a source of illumination wherein a sheet of diazo copying material is exposed to an original, and a developing chamber in which the exposed sheet of diazo copying material is exposed to ammonia vapors. The ventilation system comprises separate means for ventilating the exposure chamber and for ventilating the developing chamber. The means for ventilating the exposure chamber comprises inlet means for admitting ambient air into the exposure chamber, and outlet means for venting hot air from the exposure chamber into the ambient environment. The means for ventilating the developing chamber comprise means for vacuum exhausting ammonia laden air from the developing chamber, and cartridge means disposed within the absorber chamber for selectively absorbing ammonia fumes. By separating the air flow through the two ventilating systems in this manner, a much smaller volume of air passes through the absorber chamber, thus greatly increasing the efficiency and life of the absorber cartridge. Furthermore, by providing a switch and relay combined with a timer to operate the developing chamber ventilation system only when the developing chamber is actually in use, the life and efficiency of the absorber material is further extended.

Typically, the absorber cartridge is filled with a composite mixture of activated charcoal granules and fibrous excelsior treated with phosphoric acid. Various embodiments of such absorbing cartridges are disclosed in the above referenced U.S. Patents. In order to further prolong the life of the cartridge, a means for providing moisture within the absorber chamber may be provided. Typically, this may take the form of a small water drip. Furthermore, means may also be provided for agitating the charcoal granule/fibrous excelsior mix. A rod and mixing blade may be disposed within the absorber chamber for agitation of the mix. Both the mixing blade and the water drip will help prolong the life of the charcoal granule/fibrous excelsior mix and prevent channelization thereof.

In one embodiment of the inlet means for admitting ambient air into the exposure chamber, the inlet means may comprise a modified lamp end housing which includes means providing an aperture therein. By aligning this aperture with a similarly shaped aperture provided in a housing enclosing the diazo copy machine, room air may be directly drawn into the exposure chamber. In prior art systems, the typical lamp end housing is not provided with such an aperture; hence, ammonia laden air is drawn from the machine ends and passes directly into the exposure chamber. The aperture in the modified lamp end housing may take the form of a simple part-spherical opening formed in part of the roughly spherical lamp end housing.

BRIEF DESCRIPTION OF THE DRAWINGS

The various features, uses and advantages of the herein invention may best be understood with reference to the following detailed description and drawing in which.

DETAILED DESCRIPTION OF THE PREFERRED EMBODIMENT

Figure 2:
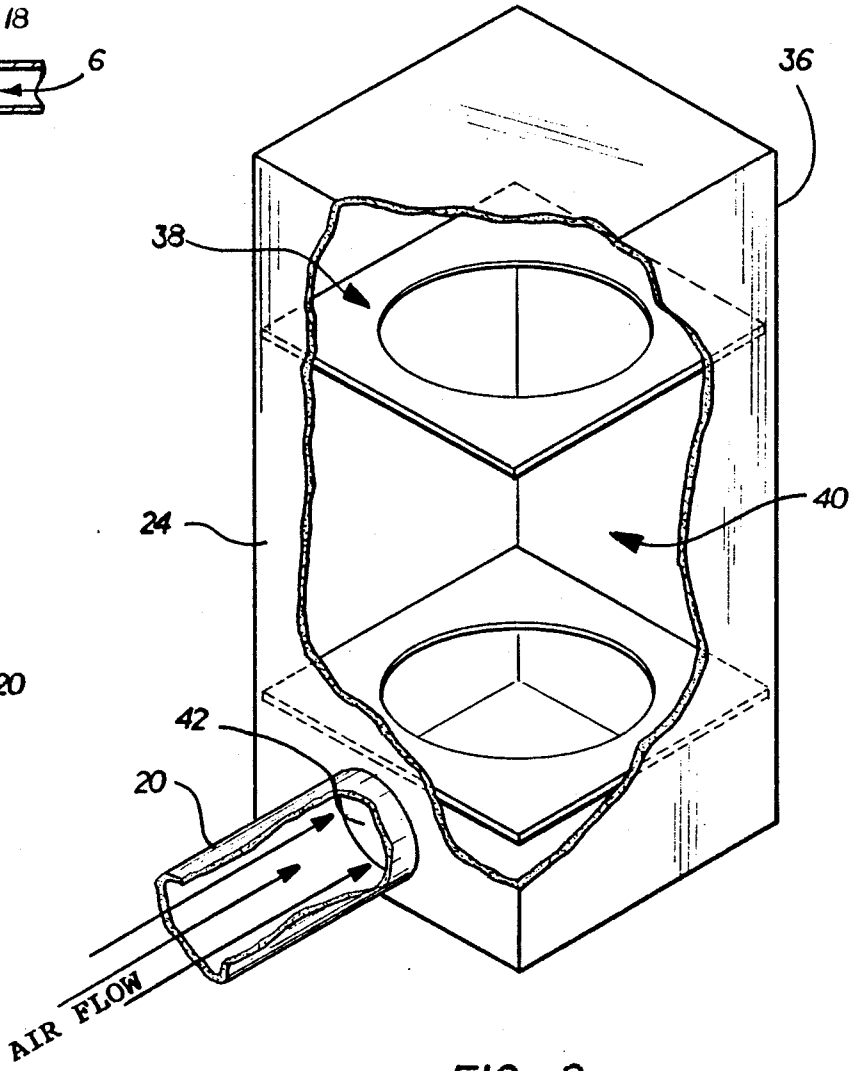
FIG. 2 is a partially cut-away perspective view of an alternate embodiment of an absorber chamber for use with the diazo machine ventilation system shown in FIG. 1.

Throughout the following detailed description, like reference numerals are used to refer to the same element of the herein invention shown in multiple embodiments thereof.

Figure 1:
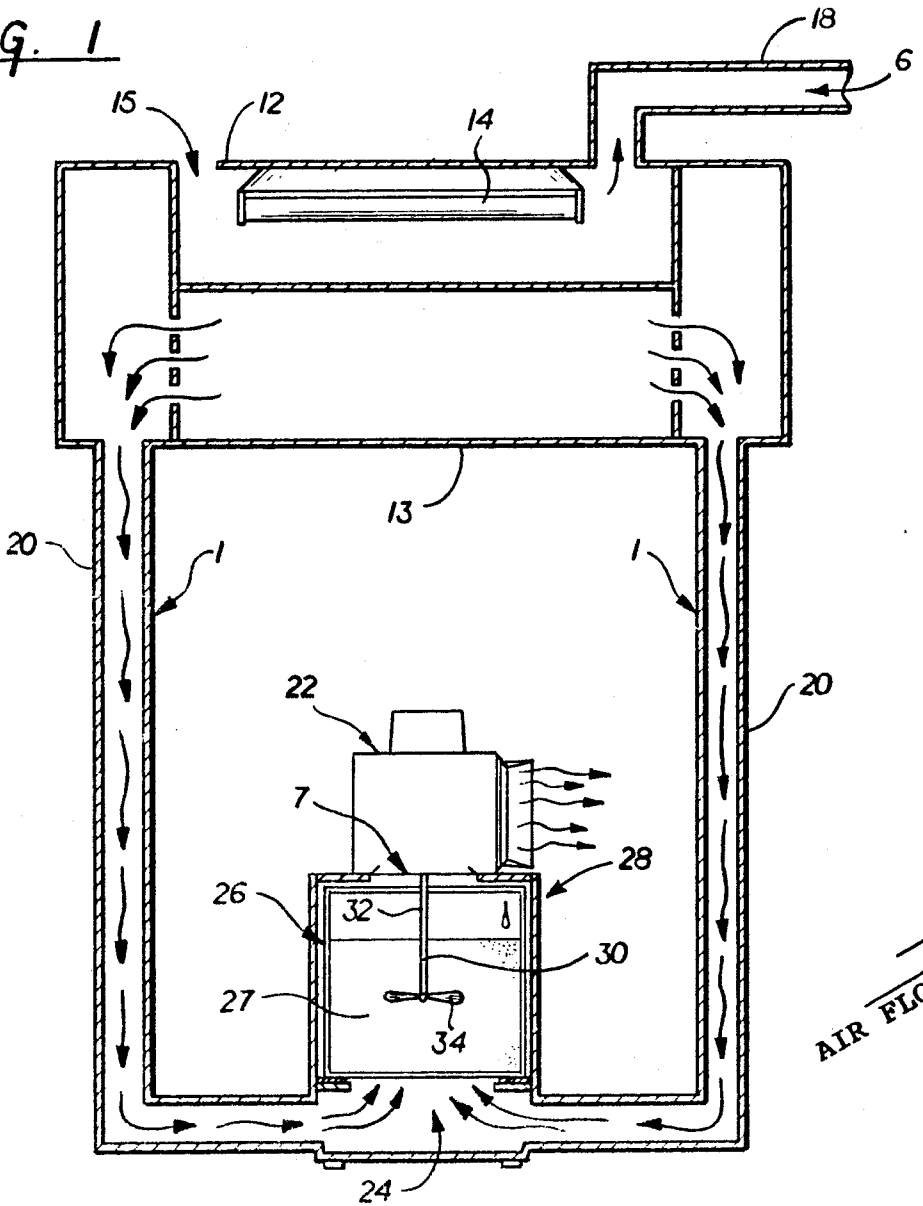
FIG. 1 is a diagrammatic illustration of the diazo machine ventilation system of the instant invention.

Referring now the drawings and in particular to FIG. 1, there is depicted diagrammatically a ventilation system 10 suitable for use with a diazo copy machine of the type having an exposure chamber 12 and a developer chamber 13. The exposure chamber 12 is provided with a source of illumination 14 for exposure of an original image (not shown) onto diazo copying material (not shown). The exposure chamber 12 is provided with an air inlet 15 for admitting ambient air therein. An outlet means 18 is provided for venting hot air from the exposure chamber into the ambient environment.

Figure 4:
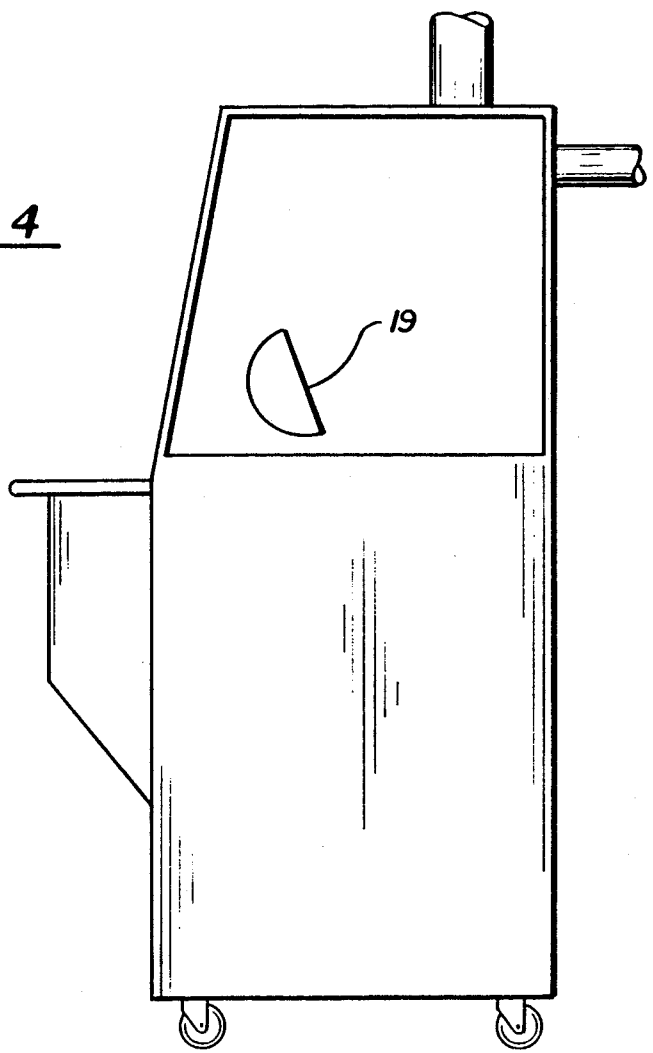
FIG. 4 is a side elevational view of a diazo copying machine with the modified lamp end housing shown in FIG. 3*b* installed.
Figure 3A:
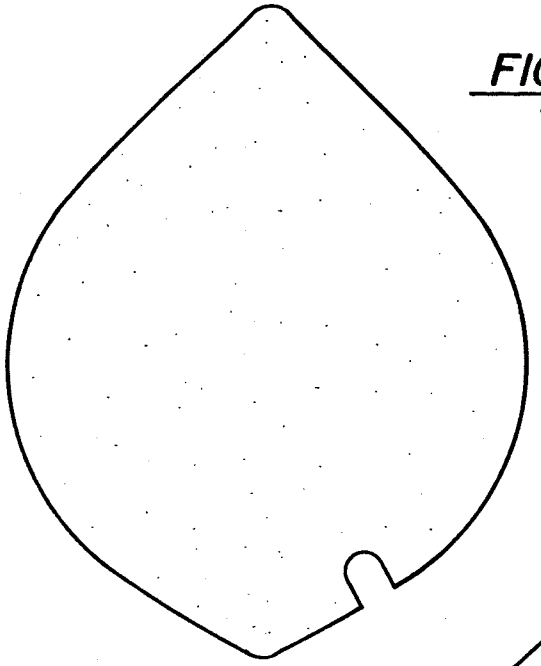
FIGS. 3*a* and 3*b* illustrate, respectively, a conventional lamp end housing and a modified lamp end housing constructed in accordance with the teachings of the instant invention.
Figure 3B:
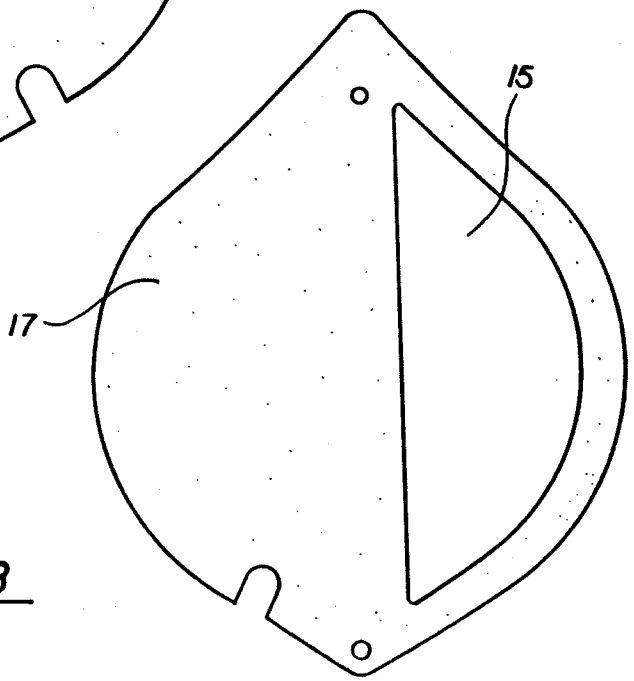

As may be seen with reference to FIGS. 3 and 4, the inlet means 15 for admitting ambient air into exposure chamber 12 may take the form of a modified lamp end housing 17, depicted in FIG. 3*b*. A conventional prior art lamp end housing is shown in FIG. 3*a*. Typically, this takes the unapertured configuration shown. The modified lamp end housing 17 shown in FIG. 3*b* contains means defining an aperture 15 for the admission of ambient air therethrough. Typically, the aperture 15 is roughly part spherical in configuration. When aligned with a similarly shaped aperture 19 formed in the housing 11 of a diazo copy machine, as may be seen in FIG. 4, ambient air may enter aperture 15, flow through exposure chamber 14, and exit therefrom via outlet means 18. The direction of this airflow is depicted by the arrows shown in FIG. 1. Hence, a separate and self-contained ventilation path for exposure chamber 14 is provided. Any ammonia fumes from developing chamber 13 are kept separate from exposure chamber 12. Hence, outlet means 18 may vent directly into the ambient environment. Means may also be provided (not shown) for circulating the air through exposure chamber 12.

A separate airflow path is provided for ventilating the developing chamber 13. Means 22 for vacuum exhausting ammonia-laden air from the developing chamber 13 are provided. Ammonia-laden air from developer chamber 13 is exhausted therefrom via fluid conduits 20. Fluid conduits 20 are in fluid communication with an absorber chamber 24. Hence, the ammonia-laden fumes are drawn into absorber chamber 24. Cartridge means 26 are disposed within absorber chamber 24 for selectively absorbing ammonia fumes. Cartridge means 26 preferably contains a composite mixture 27 of granular and fibrous absorbing materials to reduce the tendency to channelize. Each of such materials has a somewhat different absorbent characteristic such that a more complete absorbing of the ammonia fumes under various operating conditions can be ensured. This mixture 27 includes more or less equal parts of activated charcoal granules, vermiculite granules treated with phosphoric acid, and also a fibrous absorbent excelsior also treated with phosphoric acid.

This mixture 27 of fibrous and granular absorbence produces a composite absorbent material having the favorable attributes of each. The presence of the excelsior tends to prevent crusting and channelization, which in the presence of the granular charcoal and vermiculite increases the density of the composites by packing into the spaces between the granules and results in a broad spectrum absorbent characteristic. All of these substances effectively absorb ammonia such that the exhaust from cartridge 26 will be substantially free of ammonia vapors.

To further prolong the life of mixture 27 and prevent channelization thereof, means 28 may be included for providing a source of moisture within the absorber chamber. In one embodiment, the means for providing moisture 28 comprises a device for creating a small water drip within absorber chamber 24. Furthermore, means 34 for agitating the activated charcoal granules and fibrous excelsior 27 may be provided. Preferably, the means for agitating 30 comprises a mixing rod 32 and mixing blades 34. By agitating the fibrous mixture 27, channelization thereof is prevented.

An alternative embodiment of the means for vacuum exhausting 22 and absorber chamber 24 are depicted in FIG. 2, where these elements are depicted as part of a single, plug-in module 36. An upper chamber 38 is provided for containing a vacuum chamber motor (not shown). A lower chamber 40 is provided which is configured to contain absorber cartridge 26. An inlet 42 is provided in the bottom of module 36 which may be attached to fluid conduit 20 for the introduction of ammonia-laden vapor from developer chamber 13 into module 36. The vacuum motor disposed in upper chamber 38 will draw the ammonia-laden fumes through lower chamber 40, thus causing them to pass through absorber cartridge 26.

The airflow path of the ammonia-laden fumes are depicted by the arrows shown in FIG. 1. As may be seen, the ammonia-laden fumes are drawn from developing chamber 13, and then passed through fluid conduits 20. The fumes then enter absorber chamber 24 and absorber canister 26, where they will come into contact with fibrous material 27. As a result of this contact, the ammonia from the vacuum exhausted air will be absorbed, and the deammonized air may be exhausted from the system as being substantially free of ammonia vapors.

The advantages of the herein invention for providing separate airflows through the exposure chamber 12 and the developer chamber 13 are readily apparent. The airflow passing through exposure chamber 12 does not come into contact with ammonia vapor, and, hence, may be directly vented into the room via outlet 18. Hence, no expensive duct work is needed for this part of the system. Likewise, since the ammonia contaminants are effectively removed inside absorber chamber 26, the deammonized air may also be exhausted into the ambient environment.

Since a substantial part of the airflow through a diazo copy machine is through the exposure chamber, by separating the airflow, only a part of the airflow through the machine need be diverted through the deammonizing chamber described above. Hence, by reducing the amount of air flowing through this part of the system, the life of the ammonia-absorbing material contained within the absorber chamber is greatly prolonged. Hence, the practicality of a system utilizing an ammonia absorber is greatly enhanced. This utility is even further enhanced if a separate switch and relay in combination with a timer, schematically depicted in FIG. 1 as reference numeral 44, is added to the system. By use of the switch and relay with timer 44, the ventilation system for the developer chamber 13 may be operated only when the developing chamber 13 is in use. Hence, unnecessary airflow through the absorber chamber 26 is prevented. Again, this has the effect of greatly prolonging the life of the absorber material 27.

It is contemplated that existing prior art diazo copy machines which do not have separated airflows through their exposure and developing chambers may be retrofitted to provide a separated airflow. For example, such a copy machine fitted with an ammonia vapor absorbing system of the type disclosed in, for example, U.S. Pat. No. 4,473,282 may be provided with the modified lamp and housing disclosed herein. A suitable aperture may then be made in the housing of the copy machine to permit ambient air to enter the exposure chamber. Outlet means may then be retrofitted onto the exposure chamber for exhaustion of air into the ambient environment.

Obviously, many embodiments, designs and arrangements of the system disclosed herein may occur to one skilled in the art of diazo machine design without departing from the spirit of the inventive concept disclosed and claimed herein. While the herein invention has been disclosed with reference to certain exemplifications and embodiments thereof, it is not intended to be limited so but solely by the claims appended hereto.

We claim:

1. A ventilation system for a two chamber diazo copy machine of the type having an exposure chamber containing a source of illumination for exposure of an original image onto diazo copying material and a developer chamber utilizing ammonia vapors to develop the image on the diazo copying material, the ventilation system comprising:

means for ventilating the exposure chamber including:

inlet means for admitting ambient air into the exposure chamber; and outlet means for venting hot air from the exposure chamber into the ambient environment;

means for ventilating the developing chamber including:

means for vacuum exhausting ammonia laden air from the developing chamber;

an absorber chamber in fluid communication with the developing chamber whereby ammonia laden fumes therefrom may be drawn into the absorber chamber; and cartridge means disposed within the absorber chamber for selectively absorbing ammonia fumes.

2. The system of claim 1 wherein the means for ventilating the developer chamber further comprises means for providing a source of moisture within the absorber chamber.

3. The sytem of claim 2 wherein the means for providing moisture within the absorber chamber is a device for creating a small water drip.

4. The system of claim 1 wherein the cartridge means contains a composite mixture of activated charcoal granules and fibrous excelsior treated with phosphoric acid for selectively absorbing ammonia fumes.

5. The system of claim 4 wherein the means for ventilating the developer chamber further comprises means for agitating the activated charcoal granules and fibrous excelsior.

6. The system of claim 5 wherein the means for agitating comprises a mixing rod and blade.

7. The system of claim 1 further comprising the combination of a switch and relay with a timer to operate the means for ventilating the developer chamber only when the developer chamber is in use.

8. The system of claim 1 wherein the source of illumination within the exposure chamber is a fluorescent tube adapted to be inserted into a lamp, and wherein the inlet means for admitting ambient air into the developing chamber comprises a lamp end housing with means forming an aperture therein of a sufficient size to allow an adequate air flow therethrough.

9. The system of claim 1 wherein the aperture in the lamp end housing is part-spherical in configuration.

10. A lamp end housing for use with a fluorescent tube adapted to provide illumination for exposing an original image onto diazo copying material in an exposure chamber of a two chamber diazo copy machine, said lamp end housing being provided with means forming an aperture therein for admitting ambient air into the exposure chamber.

11. The lamp end housing of claim 10 wherein the aperture is part-spherical in configuration.

* * * * *